US012037745B2

(12) United States Patent
Bai et al.

(10) Patent No.: US 12,037,745 B2
(45) Date of Patent: Jul. 16, 2024

(54) PROCESS FOR PRODUCING BINDERLESS FORMALDEHYDE-FREE FIBERBOARD AND COPRODUCING FULVIC ACID FROM STRAW

(71) Applicants: Bo Bai, Shanghai (CN); Xiaofei Shi, Zibo (CN)

(72) Inventors: Bo Bai, Shanghai (CN); Jiani Bai, Shanghai (CN); Dong Wang, Shanghai (CN); Yufang Liu, Shanghai (CN); Xiaofei Shi, Shanghai (CN)

(73) Assignee: DAHE (SHANGHAI) ECOLOGICAL TECHNOLOGY CO., LTD., Shanghai (CN)

( * ) Notice: Subject to any disclaimer, the term of this patent is extended or adjusted under 35 U.S.C. 154(b) by 204 days.

(21) Appl. No.: 17/640,385

(22) PCT Filed: Aug. 19, 2021

(86) PCT No.: PCT/CN2021/113534
§ 371 (c)(1),
(2) Date: Mar. 4, 2022

(87) PCT Pub. No.: WO2022/052775
PCT Pub. Date: Mar. 17, 2022

(65) Prior Publication Data

US 2022/0333308 A1 Oct. 20, 2022

(30) Foreign Application Priority Data

Sep. 10, 2020 (CN) ..... 202010945899.X

(51) Int. Cl.
*D21H 11/12* (2006.01)
*D21C 9/02* (2006.01)
(Continued)

(52) U.S. Cl.
CPC ..... *D21H 11/12* (2013.01); *D21C 9/02* (2013.01); *D21C 11/0007* (2013.01); *D21D 1/20* (2013.01)

(58) Field of Classification Search
CPC ..... D21H 11/12; D21C 11/0007
See application file for complete search history.

(56) References Cited

U.S. PATENT DOCUMENTS

| | | | | |
|---|---|---|---|---|
| 4,194,997 A * | 3/1980 | Edler | C08L 97/02 | 428/407 |
| 2002/0065400 A1* | 5/2002 | Raskin | C08H 6/00 | 530/500 |
| 2023/0220623 A1* | 7/2023 | Bai | D21C 5/00 | 162/16 |

FOREIGN PATENT DOCUMENTS

| | | |
|---|---|---|
| CN | 101450955 A | 6/2009 |
| CN | 101451315 A | 6/2009 |

(Continued)

OTHER PUBLICATIONS

English translation of CN 109306638 B, downloaded Nov. 18, 2023. (Year: 2023).*

(Continued)

*Primary Examiner* — Anthony Calandra
(74) *Attorney, Agent, or Firm* — Oliff PLC

(57) ABSTRACT

A process for producing binderless formaldehyde-free fiberboard and coproducing fulvic acid from straw. All-element purification, activation, saccharification and separation are carried out on the non-wood fiber raw material through boiling and defibering to obtain primarily activated lignin, purified and activated fibers, monosaccharides of hemicellulose and non-wood fibers, and fulvic acid. Deep activation is carried out on activated lignin. The binderless formaldehyde-free fiberboard is produced by using sufficiently activated lignin and low-molecular-weight monosaccharides as (Continued)

a hardener and binder. By sufficiently activating the lignin, comprehensive utilization of straw fiber as resources is realized, and the special requirements of binderless formaldehyde-free fiberboard for high-quality fibrous raw material and high-activity lignin are met. The boiled dilute black liquor was subjected to extraction and concentrated to obtain fulvic acid, thereby avoiding pollution caused by pulping and board production. The distilled water obtained by carrying out evaporative concentration on the boiled dilute black liquor is reused.

14 Claims, 4 Drawing Sheets

(51) Int. Cl.
*D21C 11/00* (2006.01)
*D21D 1/20* (2006.01)

(56) References Cited

FOREIGN PATENT DOCUMENTS

| | | | | | |
|---|---|---|---|---|---|
| CN | 105026512 | A | * | 11/2015 | ..... B27N 1/006 |
| CN | 107337774 | A | | 11/2017 | |
| CN | 108485285 | A | * | 9/2018 | |
| CN | 108611912 | A | | 10/2018 | |
| CN | 109183480 | A | | 1/2019 | |
| CN | 110549456 | A | | 12/2019 | |
| CN | 110670396 | A | | 1/2020 | |
| CN | 110846345 | A | | 2/2020 | |
| CN | 112025906 | A | | 12/2020 | |
| CN | 109306638 | B | * | 6/2021 | ..... C08H 1/00 |
| GB | 2530987 | A | | 4/2016 | |
| JP | H09-268431 | A | | 10/1997 | |
| JP | 2009-041175 | A | | 2/2009 | |
| WO | WO-2011097719 | A1 | * | 8/2011 | ..... B29C 70/12 |

OTHER PUBLICATIONS

English translation of CN108485285A1 (Year: 2018).*
English translation of CN105026512A1 (Year: 2015).*
Nov. 19, 2021 International Search Report issued in International Patent Application No. PCT/CN2021/113534.
Nov. 19, 2021 Written Opinion issued in International Patent Application No. PCT/CN2021/113534.
Jul. 2, 2021 Office Action issued in Chinese Patent Application No. 202010945899.X.

* cited by examiner

PROCESS FOR PRODUCING BINDERLESS FORMALDEHYDE-FREE FIBERBOARD AND COPRODUCING FULVIC ACID FROM STRAW

TECHNICAL FIELD

The present invention belongs to the fields of comprehensive utilization of straw as resources and clean production of circular economy industry, and in particular relates to a process for producing binderless formaldehyde-free fiberboard and coproducing fulvic acid from straw.

BACKGROUND

The information disclosed in this Background section is only intended to enhance the understanding of the general background of the present invention and should not necessarily be taken as an acknowledgement or any form of implication that this information forms the prior art already known to a person of ordinary skill in the art.

Fiberboard has large market capacity and wide applicability. However, fiberboard consumes lots of wood, and the emission of formaldehyde from fiberboard seriously affects the environment and harms people's health. Meanwhile, due to technical reasons, the quality and performance of non-wood fibers leads to low product grade and poor economic benefit, which makes the abundant non-wood fiber resources not be effectively utilized. Therefore, the development of environmental protection, environmental friendliness and comprehensive utilization of resources to improve the industrial competitiveness of fiberboard has become the development trend of binderless formaldehyde-free fiberboard.

All the existing techniques for producing binderless formaldehyde-free fiberboard revolve around the separation and purification of fibrous raw materials and the activation of cellulose and lignin, but have the common problem of insufficient degree of purification and activation.

Based on the theory that plant fibers can be self-glued that has been proved and some progress has been made in the development of binderless fiberboard, some researchers have made a breakthrough in the process for preparing binderless fiberboard from cotton straw by steam explosion after repeated testing and continuous optimization. The key is to improve the performance of the binderless board and explore the gluing mechanism of the binderless fiberboard. In the tests to explore the effect of steam explosion conditions on the performance of the cotton straw raw material and binderless fiberboard thereof, it is found that steam explosion can separate cotton straw fibers, and the higher the pressure of the steam explosion, the higher the degree of separation. After the steam explosion, both cellulose and hemicellulose are partially degraded, and the higher the pressure of the steam explosion, the higher the degree of degradation. After being treated by the steam explosion, the cotton straw can be pressed into binderless fiberboard with good performance (especially waterproof performance). As the pressure of steam explosion increases, the internal bond strength increases, but the elastic modulus and the static bending strength decrease. Through exploratory test, orthogonal test and single factor test, the optimal process parameter ranges under laboratory conditions were obtained. The product performance can meet the requirements of various performance indexes in China's current Standard for Medium Density Fiberboard (GB/T 11718-1999). Several binderless gluing mechanisms are analyzed, including: hydrogen bonding, resinification of furfural, condensation of furfural and lignin, lignin-carbohydrate complexes, etc. However, treatment of non-fibrous components and high-activity lignin are not involved.

A research briefly summarizes the current wood-based panel manufacturing industry in China, investigates and analyzes the factors that can affect the wood-based panel manufacturing industry, and on this basis, introduces the formaldehyde-free wood-based panel techniques and products and analyzes the development prospects of the formaldehyde-free wood-based panel, in order to continuously promote the development of the formaldehyde-free wood-based panel products and techniques and meet the people's development needs. This research pointed out that in order to ensure the wood-based panel products to be green, the following requirements need to be met: 1) The wood-based panel products need to be environmentally friendly. That is, the production, use, disposal, recycling and other related links of the products cannot cause damage to the environment, or try to achieve minimal damage to the environment. 2) The maximum use of raw material resources can be made. 3) Energy is saved as much as possible. In the life cycle of green products, it should be ensured that energy consumption is as little as possible in all links.

A research provides a method for preparing furfural and coproducing fiberboard by extracting xylose from reed by steam explosion. The method includes: 1) fracturing and cutting reed; 2) carrying out air separation; 3) pretreating the reed with dilute acetic acid, pressing and dehydrating the reed, carrying out steam explosion, and washing the material obtained after steam explosion; 4) sending the water extract to a fractionating tower; carrying out electrodialysis to separate formic acid, acetic acid and furfural aqueous solution; 5) fermenting the reducing sugar mixture, and carrying out microfiltration; 6) carrying out reverse osmosis; 7) obtaining furfural; 8) treating and drying the obtained mixture containing solid cellulose, lignin and a small amount of hemicellulose; and 9) producing the binderless fiberboard. In this method, high-pressure steam explosion is used to make hemicellulose in the reed more easily hydrolyzed into monosaccharides or oligosaccharides under relatively low temperature steam explosion conditions. This method can not only reduce the temperature of steam explosion, but also reduce the further degradation of pentoses such as xylose, thereby enhancing the utilization rate of reed. However, extraction of fulvic acid and activation of lignin are not involved.

A research discloses a method for manufacturing fiberboard by activating lignosulfonate with laccase. The technical steps are as follows: a. separating wood or processing residues thereof into wood fibers, and drying the wood fibers; b. uniformly mixing and stirring talc and laccase, adding lignosulfonate, uniformly mixing and stirring the mixture, finally adding water, and uniformly mixing and stirring the mixture to obtain a laccase adhesive; c. stirring the wood fibers in a stirrer while spraying the adhesive obtained in step b; and d. carrying out paving, prepressing, hot pressing and post-treatment on the fiberboard obtained in step c. However, purification of raw material fibers and activation of lignin by sulfonation are not involved.

A research discloses a method for manufacturing environmentally-friendly fiberboard, relating to the technical field of chemical industry. The method includes: peeling, slicing and screening the wood to obtain acceptable wood chips, carrying out high-temperature high-pressure boiling and cellulose degradation to obtain acceptable fibers, then adding an adhesive, dyes and a hardener, carrying out drying and air separation, adding a powdery flame retardant, carrying out paving, finally making a rough board by a press, and carrying out cooling, sanding and sawing to obtain the acceptable finished board. This method can solve the problems of high consumption of flame retardant and high production cost during the manufacturing process of flame-retardant medium/high-density fiberboard. The high-temperature high-pressure boiling specifically includes: boiling the cleaned wood chips in a boiler at a temperature of 165-175° C. under a pressure of 8 bar for 2 minutes. However, the inventors have found that the purpose of the high-temperature high-pressure boiling is only to soften, but not to purify the fibers and obtain fulvic acid. Moreover, manufacturing of binderless formaldehyde-free fiberboard and waste water treatment are not involved.

SUMMARY

In order to overcome the defects in the prior art, the present invention provides a process for producing binderless formaldehyde-free fiberboard and coproducing fulvic acid from straw. Based on the comprehensive utilization of straw, a straw binderless formaldehyde-free fiberboard production system is redefined, the fibrous raw material is completely purified and activated to obtain activated lignin-fulvic acid, and the fulvic acid is used as a binder to produce the binderless formaldehyde-free fiberboard, so that the entire production technical system is redesigned.

Biomass straw is a non-wood fibrous raw material. Its chemical composition mainly includes cellulose, hemicellulose and lignin, which account for about 80% of the total mass of solid materials, and also resin, fat, a small amount of pectin, starch, tannins, pigments, crude protein and ash. The cellulose is wrapped and bound by the hemicellulose, lignin and abundant non-fibrous components. In the existing techniques for producing straw binderless formaldehyde-free fiberboard, physical, chemical and biological methods and combinations thereof are generally used to separate cellulose and lignin, purify fibers and activate the cellulose and lignin. The quality of purification and activation of the fibrous raw material directly affects the process and quality of the binderless formaldehyde-free fiberboard. The problems are: after the fibrous raw material is treated, the degree of purification of fibers is insufficient, the degree of activation of lignin is insufficient, and the effective component of the fibrous raw material is still bound in the fiber bundles and cannot exert its normal binding function; and if complete treatment is achieved, the problem in the cost and technique of waste water treatment will arise.

On the one hand, this leads to low technical threshold, low grade and low added value of products, and price competition of low-end products in the industry. On the other hand, there is a serious shortage of wood raw materials, and abundant non-wood fiber raw materials, especially crop straw resources, are not fully utilized, which seriously restricts the virtuous cycle and sustainable development of the fiberboard industry.

The Basic Technical Principle and Industrial Logic of the Present Invention are as Follows:

The basic feature of the binderless formaldehyde-free fiberboard is that there are no externally added binders, especially formaldehyde-free binders, and the fibers are bound into a board by the activity of the raw material itself and the conversion of materials.

The main components of the fibrous raw material include cellulose, hemicellulose, lignin and non-wood fiber polysaccharides.

The Technical Principle of the Present Invention is as Follows:

1. All-element purification, activation, saccharification and separation: The cellulose, the hemicellulose, the lignin and the non-wood fiber polysaccharides are subjected to complete purification, activation, low-saccharification and separation through boiling and defibering.

(1) Purification and activation of cellulose: The lignin and non-fibrous components are separated from the cellulose through boiling and defibering so as to realize purification, and the hydroxyl of the purified cellulose is sufficiently exposed, so that the activity is enhanced.

(2) Activation of lignin: By tracing the transfer locus of the lignin, the complete activation of lignin is completed through the following three steps:

Step one: The lignin is subjected to primary activation, that is, the lignin is activated by boiling with ammonium sulfite. During the boiling, the lignin is hydrolyzed to generate sulfonated lignin, namely fulvic acid, so that the lignin is activated, and the complete lignin structure surrounding the cellulose generate "cracks".

Step two: The lignin is separated from the cellulose by defibering and pulp washing. The lignin obtained after refining and defibering includes sulfonated lignin and native lignin, so that a large part of lignin and cellulose are no longer bound with each other, but released from each other. After pulp washing, the sulfonated lignin and the native lignin are separated from the cellulose, so that primarily activated lignin black liquor, that is, primary fulvic acid black liquor.

Step three: The lignin in the primary lignin black liquor is subjected to secondary activation, which is achieved by sulfonation plus phenolate in the present invention.

(3) Low-saccharification: It refers to the low-saccharification hydrolysis of hemicellulose and the low-saccharification hydrolysis of non-wood fiber polysaccharides. The monosaccharides after hydrolysis and the activated lignin constitute the main components of fulvic acid black liquor.

2. The fibers are bound into a board by the activity of the fibrous raw material itself and the conversion of materials. Under the actions of high temperature and high pressure, the binding force is generated at least from two aspects: in one aspect, the purified and activated cellulose eliminates the barriers of the lignin and non-cellulose components and forms hydrogen bonding by tight bonding, and the cellulose and the lignin also undergo hydrogen bonding; and in another aspect, the activated lignin reacts with the monosaccharides to generate the binder.

3. The deep activation of fulvic acid becomes the key fulcrum of the present invention. The native lignin in the fulvic acid black liquor is sufficiently activated by deep activation, and the activated lignin reacts with the cellulose, hemicellulose and monosaccharides under the actions of high temperature and high pressure to play the role of a hardener and a binder.

4. The fulvic acid has become the key to break through the industrial bottleneck. The small part of fulvic acid is used as the activated lignin, the low-molecular-weight monosaccharides are used as the binder, and the large part of fulvic acid is used as the high-added-value plant growth regulator, which generates good comprehensive utilization benefits of resources and provides strong economic support for the binderless formaldehyde-free fiberboard industry.

Beneficial Effects of the Present Invention are as Follows:

1. The fibrous raw material is completely purified to eliminate the obstacles of direct hydrogen bonding of fibers.

2. The fibrous raw material is completely purified and activated to obtain the activated cellulose and lignin, so that the hydrogen bonds of the cellulose and lignin are sufficiently exposed, thereby greatly increasing the degree of hydrogen bonding between fibers.

3. Using the activated lignin from the fibrous raw material as the binder can exert the superimposed effects of the binding force of the hydrogen bonds and the binding force of the hardener and binder. On the one hand, the effective combination of the cellulose hydrogen bonds and the lignin hydrogen bonds that are sufficiently exposed is exerted to realize the hydrogen bonding. On the other hand, by exerting the performance of lignin softening at high temperature and hardening at room temperature, the activated lignin is used to harden and strengthen the activated fibers.

4. The multi-component monosaccharides formed by degradation of the non-wood fibers and part of hemicellulose during the boiling and purification, including xylan, glucomannan, glucan, arabinogalactan, galacturonic acid, glucuronic acid and the like, play the binding role together with the activated lignin. The monosaccharides of hemicellulose are dehydrated and converted into furfural at high temperature, and the high pressure promotes the resinification reaction between the furfural and the activated lignin. Meanwhile, the activated small-molecule lignin undergoes a condensation reaction with the monosaccharides of the non-wood fibers to generate phenolic resin, thereby finally forming the hardener and binder for fibers.

5. The fibrous raw material is boiled and purified such that the impurity lignin is removed, thereby enhancing the degree of density of the fiberboard and being beneficial to improving the performance of the fiberboard.

6. The straw is subjected to systemic boiling, defibering and pulp washing by the ammonium sulfite method to realize purification and activation of the fibrous raw material, so that not only the purified and activated cellulose, but also the activated lignin-fulvic acid is obtained, thereby effectively enhancing the production efficiency.

7. The fulvic acid mentioned in the present invention is the activated lignin obtained from the process of boiling, defibering and pulp washing of the fibrous raw material, and is presented in the form of pulping black liquor. The fulvic acid not only meets the requirements as the hardener and binder in the production of binderless formaldehyde-free fiberboard, but also greatly improves the comprehensive utilization rate of the straw raw material resources as a high-added-value plant growth activator, thereby completely making a breakthrough in the problems of pollution and corresponding cost increase caused by the purification and activation of the fibrous raw material in the existing fiberboard production process, and changing wastes into valuable substances.

8. The product and production requirement of binderless formaldehyde-free fiberboard and the requirement of fulvic acid as the activated lignin and plant growth regulator can be both met, and the process parameters of boiling and defibering can be optimized and effectively controlled. The boiling intensity and the defibering degree are optimized according to the requirements for fiberboard product and production performance to meet the performance requirements for strength, stiffness and the like of the fiberboard. In order to ensure the activity of the lignin and the yield of the fulvic acid, sufficient temperature and holding time are required, and in order to enhance the fiber yield and stiffness of the fiberboard, the hemicellulose should be reserved as much as possible. Meanwhile, in order to obtain good appearance color of the fiberboard, it is necessary to control the pH during the boiling. When the pH is 7 or below, the obtained fibers are dark red, and the fiberboard has a good appearance. When the pH is 9 or above, the obtained fibers are black, which affects the marketability of the fiberboard.

9. Measures are taken to further enhance the activity of the activated lignin and fulvic acid. In practice, the inventor found that in order to meet the requirements for stiffness and yield of the fiberboard, it is necessary to control the boiling intensity. The boiling technique is controlled such that the fibrous raw material is boiled to a "semi-cooked" state, and then subjected to mechanical refining and defibering to obtain the fibrous raw material, so that the separation of the cellulose from the lignin largely depends on the strong "extrusion" and "tearing" of the subsequent refining and defibering. Therefore, the activated lignin black liquor obtained in the process of producing binderless formaldehyde-free fiberboard and coproducing fulvic acid, that is, the fulvic acid black liquor, contains both the sufficiently activated sulfonated lignin and the native lignin with lower activity. This has been verified and tested through the tests of the inventors.

There are many ways to enhance the activity of the native lignin in the black liquor. Through the solution design and test optimization, the present invention adopts the activation treatment of sulfonation plus phenolation, which is suitable for the specific conditions of the technical solution, is environmentally friendly, low in cost and convenient to operate, and can effectively utilize the available resources.

10. The present invention provides a complete industrial production solution for comprehensive utilization of straw as resources with strong operability. First, all the cellulose, part of the hemicellulose and part of the lignin are used to produce the fiberboard, and the remaining components enter the fulvic acid product, so that the straw fiber is fully utilized as resources. Second, the pulping black liquor is the fulvic acid black liquor, so that the wastes are changed into valuable substances, thereby avoiding the pollution from the source. Third, distilled water from the concentration of the fulvic acid black liquor is reused for boiling, defibering and pulp washing to extract the black liquor, thereby saving the water resources. Fourth, the waste heat of evaporative concentration is utilized to activate the lignin, thereby effectively saving the energy.

11. The present invention has wide range of raw materials and strong adaptability, thereby greatly saving the wood resources. This technique can produce binderless formaldehyde-free fiberboard from various plant fiber raw materials, including crop straw, various other non-wood fibers and various wood scraps.

To Achieve the Foregoing Technical Objective, the Present Invention Adopts the Following Technical Solutions:

Provided is a process for producing binderless formaldehyde-free fiberboard and coproducing fulvic acid from straw. The core content is that: non-wood fibers used as a raw material are subjected to purification, activation and saccharification, and purified cellulose, activated lignin, and monosaccharides of hemicellulose and non-wood fibers are used to produce the binderless formaldehyde-free fiberboard. Fulvic acid is obtained during the purification, activation and saccharification.

In order to manufacture the binderless formaldehyde-free fiberboard, all-element purification, activation, saccharification and separation are carried out on the existing non-wood fiber raw material. That is, the cellulose, the hemicellulose, the lignin and the non-wood fiber polysaccharides are subjected to complete purification, activation and low-saccharification through boiling and defibering, so that the hydrogen bonds of the cellulose are sufficiently exposed, thereby greatly increasing the degree of hydrogen bonding between fibers. Meanwhile, the fulvic acid is sufficiently activated, so that the sufficiently activated lignin undergoes a resinification reaction with the monosaccharides at high temperature under high pressure, and thereby, the fibers can be bound into a board at high temperature under high pressure, which meets the requirements for use.

a. Purification, activation and saccharification are carried out through boiling, defibering and pulp washing, and then separation is carried out to obtain:

purified and activated cellulose; and primarily activated lignin and low-molecular-weight monosaccharides obtained after degradation.

b. Deep activation is carried out on the primarily activated lignin.

c. The binderless formaldehyde-free fiberboard is produced by using the deeply activated lignin and monosaccharides as a hardener and binder.

d. Fulvic acid is obtained during the purification, activation of fibrous raw material.

Finally, the binderless formaldehyde-free fiberboard and the fulvic acid are obtained.

In some embodiments, the requirement of the fiberboard for the raw material and the requirement for the fulvic acid product are both met during the purification and activation by carrying out purification, activation and saccharification through boiling by an ammonium sulfite method: non-fibrous components such as pectin, wax, crude protein and crude fat and part of hemicellulose in the raw material are degraded into low-molecular-weight monosaccharides by boiling; and activated lignin is obtained by sulfonation and hydrolysis of lignin, thereby realizing primary separation of the cellulose and the lignin. The boiling process is carried out at 140-160° C. for 40-60 min, an amount of the ammonium sulfite is 8-15% by weight of the raw material, and the pH is 5-7.

In some embodiments, pulping black liquor is subjected to extraction through defibering and pulp washing to realize separation of the cellulose and the lignin, thereby obtaining the purified and activated cellulose and the activated lignin black liquor. The specific operations include: separating the cellulose from sulfonated lignin and part of native lignin by mechanical refining and defibering; and carrying out extraction on the black liquor by pulp washing to respectively obtain the cellulose and the primarily activated lignin black liquor.

The purified and activated cellulose includes part of native lignin and part of undegraded hemicellulose.

The primarily activated lignin black liquor, namely the primary fulvic acid black liquor, mainly includes sulfonated lignin (that is, activated lignin), native lignin, low-molecular-weight monosaccharides generated by the degradation of the hemicellulose, and low-molecular-weight monosaccharides generated by the degradation of the non-wood fibers, and has a solid content of 8-10%.

In some embodiments, the carrying out deep activation on the primarily activated lignin is to carry out deep activation on the sulfonated lignin black liquor obtained after the extraction by pulp washing. In some embodiments, the activation process includes: carrying out concentration, sulfonation and phenolation on the primary fulvic acid black liquor. The specific operations include: a. concentration: carrying out multiple-effect evaporation to obtain fulvic acid thick black liquor having a solid content of 40-60%, where the distilled water obtained after the concentration is reused for the boiling and pulp washing; b. sulfonation: carrying out deep sulfonation by utilizing waste heat of the evaporative concentration, where the process conditions are as follows: an amount of the ammonium sulfite added is 3-6% by weight of the black liquor, an amount of a catalyst added is 0.005-0.01% by weight of the thick black liquor, the catalyst is at least one or a mixture of $FeSO_4$, $FeCl_3$ and $CuSO_4$, the temperature is 80-95° C., the holding time is 90-180 min, and stirring is carried out every 1 min; and c. phenolation: carrying out phenolation on the thick black liquor obtained after the deep sulfonation, where the process conditions are as follows: an amount of a phenolation agent added is 0.01% by weight of the thick black liquor, the temperature is 70-80° C., and the holding time is 60-150 min. The phenolation agent includes one or a mixture of tannic acid, gallic acid, catechin, tea polyphenol and ferulic acid.

In some embodiments, the fulvic acid black liquor, that is, the deeply activated lignin and the monosaccharides of hemicellulose and non-wood fibers, is used as the hardener and binder to produce the formaldehyde-free fiberboard, and an amount of the fulvic acid black liquor added is 10-30% by weight of the fiberboard raw material, based on dry fulvic acid.

In some embodiments, part of the activated fulvic acid thick black liquor is used as the binder to produce the binderless formaldehyde-free fiberboard, and the rest may be sold directly as a commodity, or sold after being dried.

In some embodiments, the fulvic acid may be mixed with the purified and activated fibrous raw material in the form of liquid, or the fulvic acid black liquor may be dried and then mixed with the purified and activated fibrous raw material in the form of powder.

In some embodiments, the purified and activated cellulose and the activated lignin, that is, the fulvic acid, are used as the hardener and binder, a waterproofing agent is added according to a known method, and post-treatment, including paving, pressing, drying, polishing and trimming, is carried out on the fiberboard.

In some embodiments, a complete industrial production solution for preparing binderless formaldehyde-free fiberboard and fulvic acid by comprehensively utilizing straw raw material resources is provided. Preferably, an input-output ratio of the raw material and the product is controlled, that is, 2 tons of raw material produces 1 ton of fulvic acid dry powder and 1 ton of purified cellulose. The product performance is controlled, that is, a beating degree of the purified fibers after the defibering is 20-30° SR, and the content of the dry fulvic acid effective component is greater than 40%. A treatment amount of the black liquor waste water is controlled, that is, 1 ton of purified cellulose produces 8-10 tons of fulvic acid dilute black liquor, thereby producing 2 tons of fulvic acid thick black liquor, and the distilled water is reused. The color of the purified fibers is controlled, that is, the pH is controlled to be less than 7, thereby ensuring the color of the fibers to be dark red and preventing the fibers from becoming black. The sulfonation temperature and the phenolation temperature in the deep activation of the fulvic acid black liquor are controlled.

In some embodiments, this technique is applicable to all plant fibers suitable for producing fiberboard, which include crop straw raw materials such as cotton straw and wheat straw and non-wood fiber raw materials such as bamboo, reed; and wood scraps.

The Present Invention has the Following Beneficial Effects:

(1) The present invention effectively realizes purification, activation and saccharification of the fibrous raw material, and provides a high-quality fibrous raw material (that is, the purified and activated cellulose, the activated lignin, and the monosaccharides of hemicellulose and non-wood fibers) for production of high-quality fiberboard, so that the binderless formaldehyde-free fiberboard becomes high-grade pulp fiberboard, thereby improving the grade of the product.

(2) According to the present invention, the addition of the activated lignin-fulvic acid and the low-molecular-weight monosaccharides enhances the binding and hardening between fibers, so that the binding force of the hydrogen bonds and the binding force of the hardening between the fibers are superimposed, thereby increasing the bond strength of the fibers.

(3) The core of the double effects of generation and deep activation of primary fulvic acid is utilized to construct a new efficient industrial system for comprehensive utilization of resources, thereby boosting the development of the industry.

(4) The huge economic value of the fulvic acid effectively enhances the industrial competitiveness of the binderless formaldehyde-free fiberboard. In normal cases, every 2 tons of absolute dry fibrous raw material produces 1 ton of purified fiberboard raw material and 1 ton of fulvic acid dry powder (the effective content of fulvic acid is 40% or above). A small amount (generally 10-30%) of the fulvic acid produced is used to produce the fiberboard, and the rest (most) (generally 90-70%) of the fulvic acid produced is used as a plant growth regulator and soil conditioner. Therefore, the economic value and the added value of the product are higher, which can effectively feed back the binderless formaldehyde-free fiberboard.

(5) The wastes are changed into valuable substances, which is green and environmentally-friendly. The fulvic acid is directly obtained during the purification and activation of the fibrous raw material, so that the wastes are changed into valuable substances, thereby avoiding the pollution of the black liquor to the environment directly from the source, and breaking through the industrial bottleneck in current fiberboard production.

(6) Circular economy is achieved. The fulvic acid dilute black liquor is obtained by boiling (extraction) and washing, the fulvic acid dilute black liquor is concentrated by multiple-effect evaporation to obtain the commodity fulvic acid thick black liquor, and the distilled water is reused for fiber washing and fulvic acid extraction.

(7) The production system is integrated, and the system design is optimized. The production of fulvic acid, the production of binderless formaldehyde-free fiberboard, and the treatment and reuse of waste water are integrated and optimized.

(8) The purification of the fibers and the extraction of the fulvic acid can be extended to the field of production of binder-bonded formaldehyde-free fiberboard.

The implementation of the present invention realizes comprehensive utilization of straw fiber as resources, and effectively meets the special requirements of the binderless formaldehyde-free fiberboard for the high-quality fibrous raw material and the high-activity lignin, so that the quality of the fibers and the grade of the binderless formaldehyde-free fiberboard product can be greatly improved. The boiled dilute black liquor is directly subjected to extraction and then concentrated to obtain the fulvic acid, thereby avoiding the pollution of pulping from the source. The distilled water obtained by carrying out evaporative concentration on the boiled dilute black liquor is reused. The excess fulvic acid is changed into valuable substances with high added value, thereby effectively enhancing the performance, quality and market competitiveness of the straw binderless formaldehyde-free fiberboard.

In conclusion, the present invention can further improve the comprehensive utilization level of the non-wood fibers, reduce the wood cutting and pollution and improve the level of circular economy, which is beneficial to the sustainable development of the ecological industry.

BRIEF DESCRIPTION OF THE DRAWINGS

The accompanying drawings constituting a part of the present invention are used to provide a further understanding of the present invention. The exemplary embodiments of the present invention and descriptions thereof are used to explain the present invention, and do not constitute an improper limitation of the present invention.

DETAILED DESCRIPTION

Figure 1:
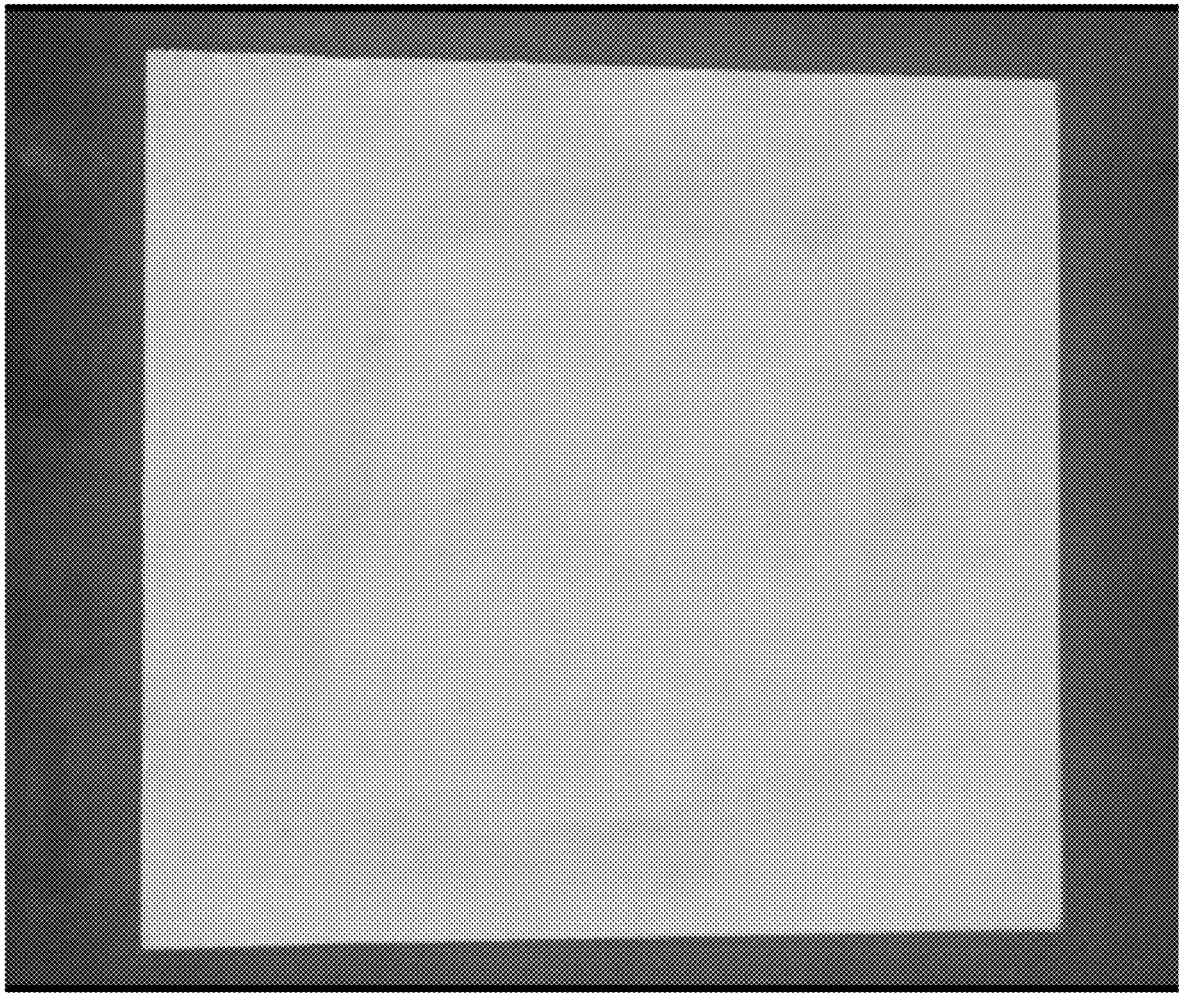
FIG. 1 is a top view of a cotton straw binderless formaldehyde-free fiberboard prepared in Embodiment 2 of the present invention, where the thickness of the board is 3 mm.
Figure 2:
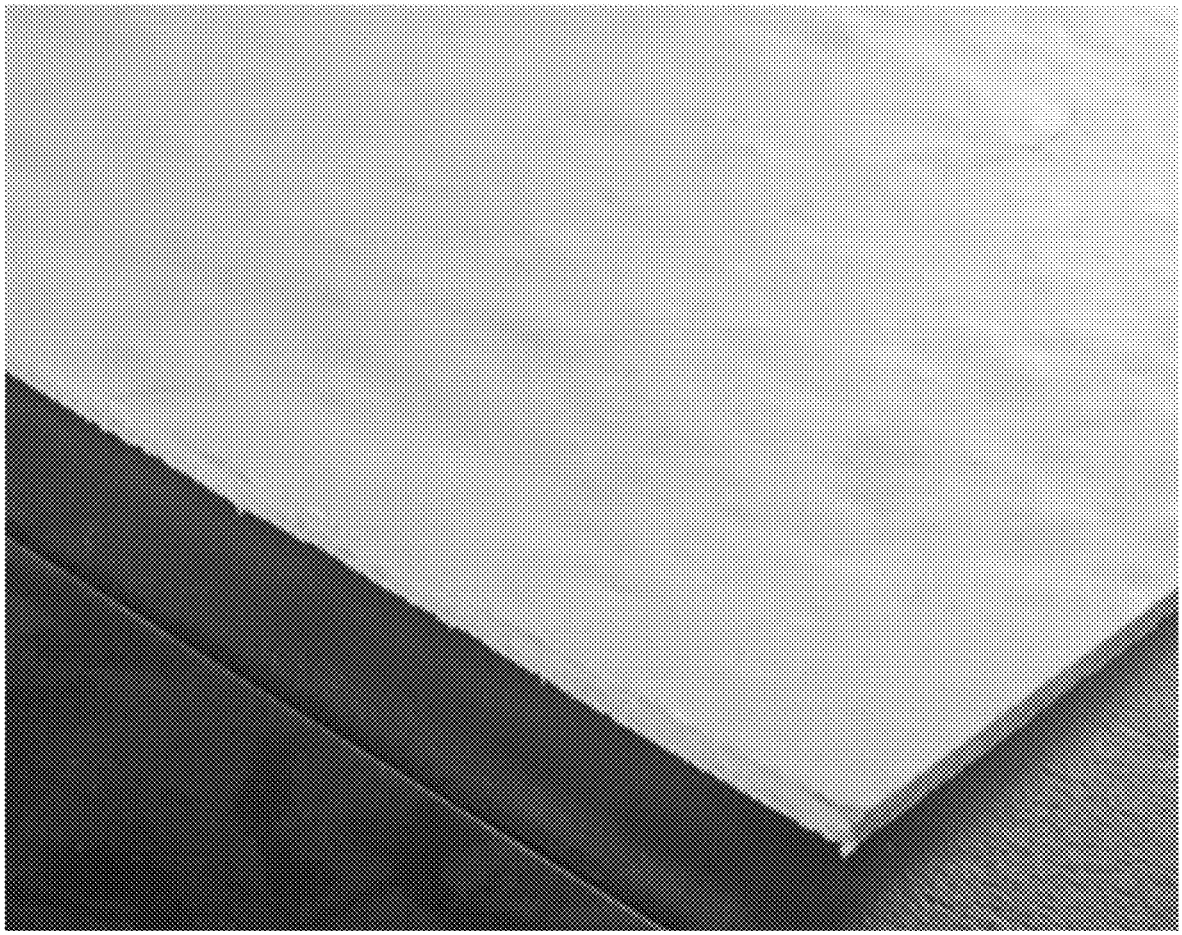
FIG. 2 is a side view of the cotton straw binderless formaldehyde-free fiberboard prepared in Embodiment 2 of the present invention.
Figure 3:
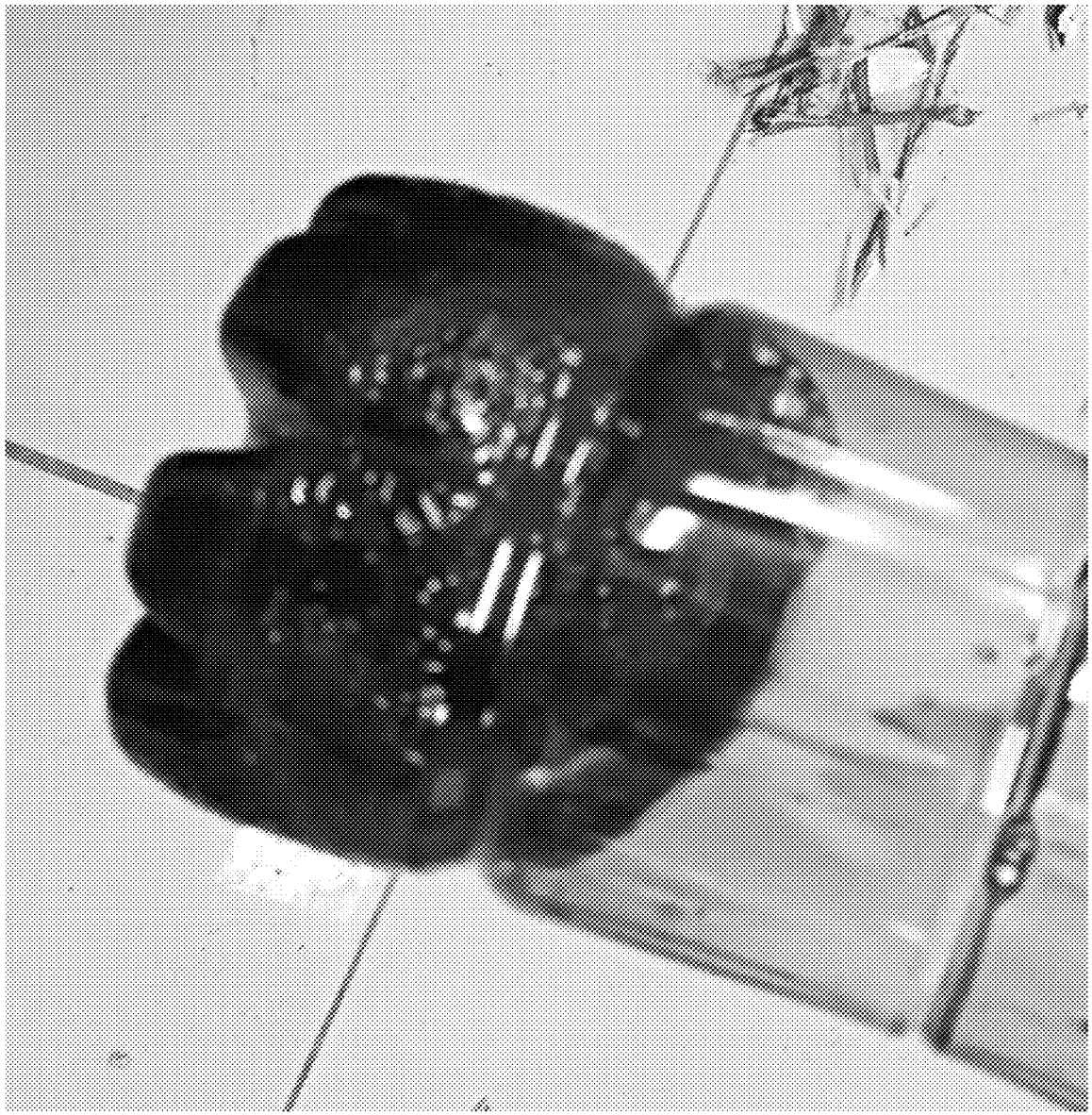
FIG. 3 is fulvic acid black liquor prepared in Embodiment 2 of the present invention.
Figure 4:
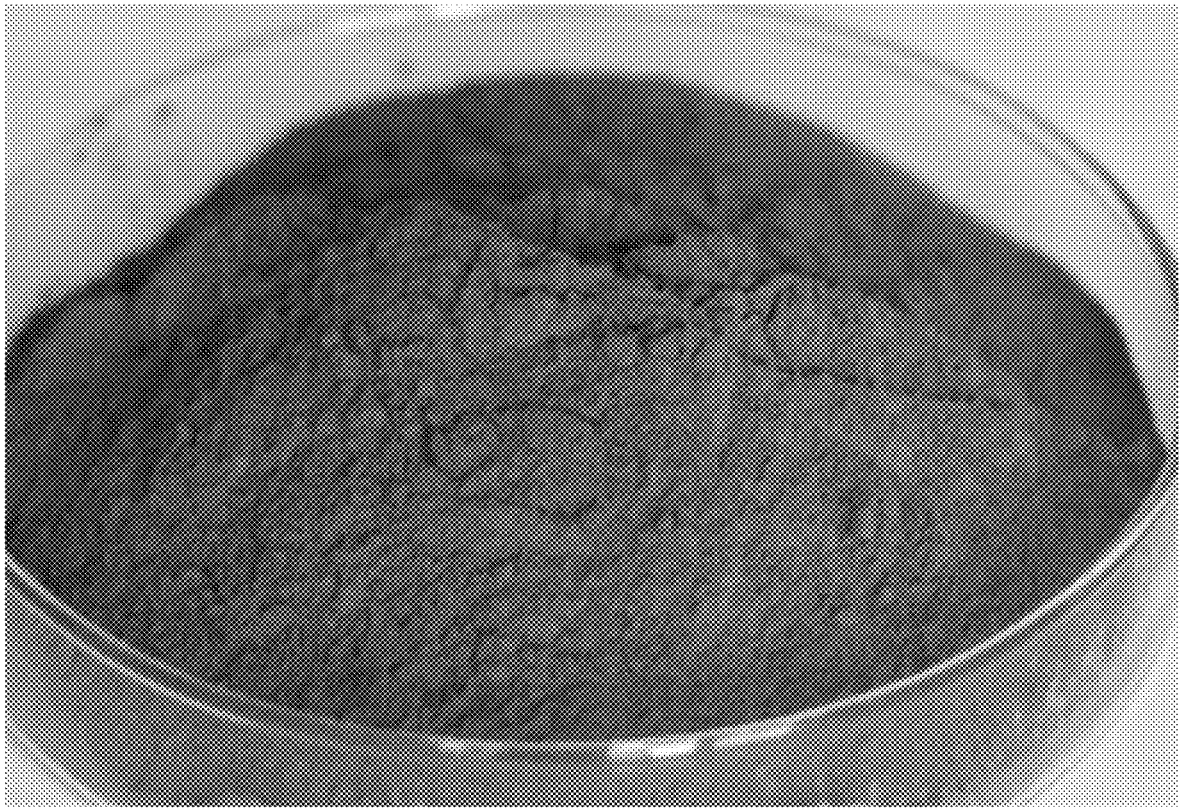
FIG. 4 is fulvic acid dry powder prepared in Embodiment 2 of the present invention.

It should be noted that, the following detailed descriptions are all exemplary, and are intended to provide further descriptions of the present invention. Unless otherwise specified, all technical and scientific terms used herein have the same meanings as those usually understood by a person of ordinary skill in the art to which the present invention belongs.

It should be noted that the terms used herein are merely used for describing specific implementations, and are not intended to limit exemplary implementations of the present invention. As used herein, the singular form is also intended to include the plural form unless the context clearly dictates otherwise. In addition, it should further be understood that, terms "comprise" and/or "include" used in this specification indicate that there are features, steps, operations, devices, components, and/or combinations thereof.

Embodiment 1

Wheat straw was used as the raw material and pulverized to 2-5 cm for later use. The process included:

Step one: The raw material was washed.

Step two: Primary purification, activation and saccharification were carried out through boiling. Add materials according to the following proportions: 2 tons of absolute dry raw material and 200 kg of ammonium sulfite were prepared, water is added according to a solid-to-liquid ratio of 1:5, the mixture was added to a spherical boiler and heated to 120° C., and steam was released. The mixture was heated to 160° C., held for 60 min and discharged. The primary purification, activation and saccharification were completed through the boiling, so that the non-wood fiber components, such as pectin, wax and the like were degraded into low-molecular-weight monosaccharides which were dissolved in the boiling liquor, and part of the hemicellulose was degraded and saccharified and were dissolved in the boiling liquor. Meanwhile, part of the lignin was sulfonated and hydrolyzed, and thus was activated, so that the whole lignin was split and primarily separated from cellulose.

Step three: The cellulose and the lignin were separated through refining and defibering. The pulp concentration was 30%. The high consistency refiner adopted two-stage grinding. The first grinding gap was 0.3 mm, and the second grinding gap was 0.15 mm. The beating degree was 25° SR. Through the refining and defibering, the whole split lignin was separated from the cellulose. The lignin included not only all the activated sulfonated lignin, but also the unactivated native lignin. Thus, the lignin and the cellulose were no longer bound with each other, but released and separated from each other.

Step four: Pulp washing was carried out to extract fulvic acid, thereby obtaining fiber pulp and fulvic acid. Counter flow washing was used to extract the fulvic acid dilution. Double-roller squeezers were used, and the counter flow washing was carried out according to 1st, 2nd, 3rd and 4th procedures. That is, in sequence, distilled water was added from the inlet of the 4th squeezer, and the fulvic acid was extracted from the outlet of the 4th squeezer; the distilled water was added from the inlet of the 3rd squeezer, and the fulvic acid was extracted from the outlet of the 3rd squeezer; the distilled water was added from the inlet of the 2nd squeezer, and the fulvic acid was extracted from the outlet of the 2nd squeezer; and the distilled water was added from the inlet of the 1st squeezer, and the fulvic acid was extracted from the outlet of the 1st squeezer. 8 tons of fulvic acid dilute black liquor per ton of pulp was obtained.

The fulvic acid was extracted through the pulp washing, thereby obtaining the fiber pulp and the fulvic acid black liquor. The fiber pulp contained purified fibers with their original activity, and part of unsulfonated and unhydrolyzed lignin and part of undegraded hemicellulose were taken away. Except the purified cellulose, part of hemicellulose and part of lignin that had been taken away, the other components in the fibrous raw material were all retained in the fulvic acid black liquor. Thus, the fulvic acid black liquor included: activated lignin (ammonium lignosulfonate), native lignin, and monosaccharides obtained after saccharification and degradation of hemicellulose and non-wood fibers. The obtained fibers were light brown in color.

Step five: Evaporative concentration was carried out. Multiple-effect evaporative concentration was carried out to obtain 2 tons of fulvic acid thick black liquor and 6 tons of distilled water per ton of pulp. The fulvic acid thick black liquor was obtained, and the distilled water was reused.

Step six: Deep activation was carried out on the fulvic acid.

First, sulfonation: deep sulfonation was carried out by utilizing waste heat of the evaporative concentration. The process conditions were as follows: an amount of ammonium sulfite added was 4% by weight of the black liquor, an amount of a catalyst $FeSO_4$ added was 0.01% by weight of the thick black liquor, the temperature was 85° C., the holding time was 120 min, and stirring was carried out every 1 min.

Second, phenolation: phenolation was carried out on the thick black liquor obtained after the deep sulfonation. The process conditions were as follows: an amount of a phenolation agent added was 0.01% by weight of the thick black liquor, the temperature was 80° C., the holding time was 90 min, and stirring was carried out every minute. The phenolation agent included tannic acid, gallic acid, catechin and tea polyphenol in a ratio of 1:1:1:1.

Comparison Before and After Activation of Fulvic Acid:

| Test item | Unit | After activation | Before activation |
|---|---|---|---|
| Fulvic acid (FA) | d % | 42.67 | 39.01 |
| Total acidic group | d, mmol/g | 4.02 | 1.16 |
| Carboxyl | d, mmol/g | 3.08 | 0.52 |
| Phenolic hydroxyl | d, mmol/g | 0.94 | 0.64 |
| Water content | Mad % | 5.6 | 5.27 |

The distilled water was reused for boiling and fulvic acid dilute black liquor extraction. Step seven: 20% of the fulvic acid thick black liquor was directly used for production of binderless formaldehyde-free fiberboard, and the rest (80%) of the fulvic acid thick black liquor was sold as a commodity, or spray-dried to obtain the commodity fulvic acid dry powder.

Step eight: The board was produced, and indexes were tested.

Experimental conditions: SYD1 test hot press, produced by Shanghai Liangjun Hydraulic Equipment Co., Ltd., and a flat pressing method were adopted for testing. The wheat straw purified fiber pulp with an absolute dry weight of 1 kg prepared in step four, 200 g of fulvic acid dry powder and 20 g of paraffin were taken and dried until the water content reached 15%, and the mixture was stirred uniformly in a glue stirrer for later use. The high-density fiberboard having a size of 300 mm*300 mm and a thickness of 3 mm was produced. The hot pressing pressure was 3.5 MPa, the hot pressing temperature was 190° C., and the hot pressing time was 9 min.

Test Index:

| | |
|---|---|
| Density (g/cm$^3$) | 0.97 |
| Static bending strength (MPa) | 38 |
| Elastic modulus (MPa) | 3910 |
| Internal bond strength (MPa) | 0.96 |
| Thickness expansion rate of water absorbing (%): | 16 |

The main indexes meet or exceed the standard for Common Type in GB/T 31765-2015 "High Density Fiberboard".

Embodiment 2

Cotton straw was used as the raw material and pulverized to 2-5 cm for later use. The process included:

Step one: The raw material was washed.

Step two: Primary purification, activation and saccharification were carried out through boiling. Add materials according to the following proportions: 1 kg of absolute dry raw material and 200 g of ammonium sulfite were prepared, water is added according to a solid-to-liquid ratio of 1:5, the mixture was added to a 15 L electric heating rotary boiler and heated to 120° C., and steam was released. The mixture was heated to 160° C., held for 60 min and discharged. The primary purification and activation were completed through the boiling, so that the non-wood fiber components, such as pectin, wax were degraded into low-molecular-weight monosaccharides which were dissolved in the boiling liquor, and part of the hemicellulose was degraded and saccharified and were dissolved in the boiling liquor. Meanwhile, part of the lignin was sulfonated and hydrolyzed, and thus was activated, so that the whole lignin was split and primarily separated from cellulose.

Step three: The cellulose and the lignin were separated through refining and defibering. The pulp concentration was 20%, and the refining was carried out in a KRK300 test refiner. The first grinding gap was 0.5 mm, the second grinding gap was 0.25 mm, and the third grinding gap was 0.15 mm. The beating degree was 28° SR. Through the refining and defibering, the whole split lignin was separated from the cellulose. The lignin included not only all the activated sulfonated lignin, but also the unactivated native lignin. Thus, the lignin and the cellulose were no longer bound with each other, but released and separated from each other.

Step four: Pulp washing was carried out to extract fulvic acid, thereby obtaining fiber pulp and fulvic acid black liquor. The fibers were dark brown.

The total water consumption during the three stages of refining was controlled within 5 kg, and plus clear water for pulp washing, the total water consumption was controlled within 10 kg.

The fulvic acid was extracted through the pulp washing, thereby obtaining the fiber pulp and the fulvic acid black liquor. The fiber pulp contained purified fibers with their original activity, and part of lignin and part of undegraded hemicellulose were taken away. Except the purified fibers, part of hemicellulose and part of lignin that had been taken away, the other components in the fibrous raw material were all retained in the fulvic acid black liquor. Thus, the fulvic acid included: activated lignin (ammonium lignosulfonate), native lignin, and monosaccharides obtained after saccharification and degradation of hemicellulose and non-wood fibers.

Step five: Evaporative concentration was carried out. Evaporation was carried out in an open port at 98° C. until the black liquor was concentrated to 2 L.

Step six: Deep activation was carried out on the fulvic acid.

First, sulfonation: deep sulfonation was carried out by utilizing waste heat of the evaporative concentration. The process conditions were as follows: an amount of ammonium sulfite added was 4% by weight of the black liquor, an amount of a catalyst $FeSO_4$ added was 0.01% by weight of the thick black liquor, the temperature was 85° C., the holding time was 120 min, and stirring was carried out every 1 min.

Second, phenolation: phenolation was carried out on the thick black liquor obtained after the deep sulfonation. The process conditions were as follows: an amount of a phenolation agent added was 0.01% by weight of the thick black liquor, the temperature was 80° C., the holding time was 90 min, and stirring was carried out every minute. The phenolation agent included tannic acid, gallic acid, catechin and tea polyphenol in a ratio of 1:1:1:1.

Step seven: The fulvic acid thick black liquor obtained after the deep activation was directly used for production of binderless formaldehyde-free fiberboard.

Step eight: The board was produced, and indexes were tested.

Experimental conditions: SYD1 test hot press, produced by Shanghai Liangjun Hydraulic Equipment Co., Ltd., and a flat pressing method were adopted for testing. The cotton straw purified fiber pulp with an absolute dry weight of 1 kg prepared in step four, 400 g of fulvic acid thick black liquor and 20 g of paraffin were taken and dried until the water content reached 15%, and the mixture was stirred uniformly in a glue stirrer for later use. The high-density fiberboard having a size of 300 mm*300 mm and a thickness of 3 mm was produced. The hot pressing pressure was 3.5 MPa, the hot pressing temperature was 190° C., and the hot pressing time was 9 min.

Test Index:

| | |
|---|---|
| Density (g/cm$^3$) | 0.98 |
| Static bending strength (MPa) | 39 |
| Elastic modulus (MPa) | 3976 |
| Internal bond strength (MPa) | 0.98 |
| Thickness expansion rate of water absorbing (%): | 16 |

The main indexes meet or exceed the standard for Common Type in GB/T 31765-2015 "High Density Fiberboard".

Embodiment 3

Cotton straw was used as the raw material.

Step one to step seven were the same as in Embodiment 2.

Step eight: The board was produced, and indexes were tested.

Experimental conditions: SYD1 test hot press, produced by Shanghai Liangjun Hydraulic Equipment Co., Ltd., and a flat pressing method were adopted for testing. The cotton straw purified fiber pulp with an absolute dry weight of 1 kg, 400 g of fulvic acid black liquor and 20 g of paraffin were taken and dried until the water content reached 15%, and the mixture was stirred uniformly in a glue stirrer for later use. The high-density fiberboard having a size of 300 mm*300 mm and a thickness of 3 mm was produced. The hot pressing pressure was 4 MPa, the hot pressing temperature was 200° C., and the hot pressing time was 10 min.

Test Index:

| | |
|---|---|
| Density (g/cm$^3$) | 1.03 |
| Static bending strength (MPa) | 44 |
| Elastic modulus (MPa) | 4120 |
| Internal bond strength (MPa) | 1.15 |
| Thickness expansion rate of water absorbing (%): | 14 |

The main indexes meet or exceed the standard for Common Type in GB/T 31765-2015 "High Density Fiberboard".

Embodiment 4

Cotton straw was used as the raw material.

Step one to step seven were the same as in Embodiment 2.

Step eight: The board was produced, and indexes were tested.

Experimental conditions: SYD1 test hot press, produced by Shanghai Liangjun Hydraulic Equipment Co., Ltd., and a flat pressing method were adopted for testing. The cotton straw purified fiber pulp with an absolute dry weight of 1 kg, 200 g of fulvic acid black liquor and 20 g of paraffin were taken and dried until the water content reached 15%, and the mixture was stirred uniformly in a glue stirrer for later use. The high-density fiberboard having a size of 300 mm*300 mm and a thickness of 3 mm was produced. The hot pressing pressure was 3.5 MPa, the hot pressing temperature was 190° C., and the hot pressing time was 12 min.

Test Index:

| | |
|---|---|
| Density (g/cm$_3$) | 0.96 |
| Static bending strength (MPa) | 39 |
| Elastic modulus (MPa) | 3936 |

-continued

| | |
|---|---|
| Internal bond strength (MPa) | 0.97 |
| Thickness expansion rate of water absorbing (%): | 16 |

The main indexes meet or exceed the standard for Common Type in GB/T 31765-2015 "High Density Fiberboard".

Embodiment 5

Cotton straw was used as the raw material.

Step one: The raw material was washed.

Step two: Primary purification and activation were carried out through boiling. Add materials according to the following proportions: 1 kg of absolute dry raw material and 200 g of ammonium sulfite were prepared, water is added according to a solid-to-liquid ratio of 1:5, the mixture was added to a 15 L boiler and heated to 120° C., and steam was released. The mixture was heated to 160° C., held for 120 min and discharged.

The measured yield of fulvic acid (on dry basis) was 34%.

The boiling time was extended from 60 min to 120 min, and the yield of fulvic acid was 34%, which did not reach the target expected value of 40% and did not increase but decrease. Practice had proved that the yield of fiber pulp was decreased from 50% to 45%. This indicated that too long boiling time reduced the yield of fulvic acid and the yield of fiber pulp. In production, the boiling scheme needs to be optimized according to the raw material conditions and product requirements.

Embodiment 6

Cotton straw was used as the raw material.

Step one: The raw material was washed.

Step two: Primary purification and activation were carried out through boiling. Add materials according to the following proportions: 1 kg of absolute dry raw material and 100 g of ammonium sulfite were prepared, water is added according to a solid-to-liquid ratio of 1:5, the mixture was added to a 15 L boiler and heated to 120° C., and steam was released. The mixture was heated to 140° C., held for 60 min and discharged.

The measured yield of fulvic acid (on dry basis) was 26%.

This indicated that the boiling intensity was insufficient, and the content of fulvic acid was 26% on dry basis, which was not ideal.

Embodiment 7

Cotton straw was used as the raw material.

Step one to step seven were the same as in Embodiment 2.

Step eight: The board was produced, and indexes were tested.

Experimental conditions: SYD1 test hot press, produced by Shanghai Liangjun Hydraulic Equipment Co., Ltd., and a flat pressing method were adopted for testing. The cotton straw purified fiber pulp with an absolute dry weight of 1 kg, 0 g of fulvic acid black liquor and 20 g of paraffin were taken and dried until the water content reached 15%, and the mixture was stirred uniformly in a glue stirrer for later use. The high-density fiberboard having a size of 300 mm*300 mm and a thickness of 3 mm was produced. The hot pressing pressure was 3.5 MPa, the hot pressing temperature was 190° C., and the hot pressing time was 9 min.

Test Index:

| | |
|---|---|
| Density (g/cm$^3$) | 0.78 |
| Static bending strength (MPa) | 26 |
| Elastic modulus (MPa) | 2420 |
| Internal bond strength (MPa | 0.55 |
| Thickness expansion rate of water absorbing (%): | 26 |

The main indexes do not meet the standard for Common Type in GB/T 31765-2015 "High Density Fiberboard".

Embodiment 8

The difference from Embodiment 2 is that: in step six, the process conditions for the phenolation were as follows: an amount of a phenolation agent added was 0.01% by weight of the thick black liquor, the temperature was 70° C., the holding time was 150 min, and stirring was carried out every minute.

Embodiment 9

The difference from Embodiment 2 is that: in step six, the process conditions for the phenolation were as follows: an amount of a phenolation agent added was 0.01% by weight of the thick black liquor, the phenolation agent included tannic acid, gallic acid, catechin, tea polyphenol and ferulic acid in a ratio of 1:1:1:1:1, the temperature was 75° C., the holding time was 100 min, and stirring was carried out every minute.

It should be finally noted that the foregoing descriptions are merely preferred embodiments of the present invention, but are not intended to limit the present invention. Although the present invention has been described in detail with reference to the foregoing embodiments, for a person of ordinary skill in the art, modifications can be made to the technical solutions described in the foregoing embodiments, or equivalent replacements can be made to some technical features in the technical solutions. Any modification, equivalent replacement, or improvement made within the spirit and principle of the present invention shall fall within the protection scope of the present invention. The specific implementations of the present invention are described above, but are not intended to limit the protection scope of the present invention. A person skilled in the art should understand that various modifications or deformations may be made without creative efforts based on the technical solutions of the present invention, and such modifications or deformations shall fall within the protection scope of the present invention.

What is claimed is:

1. A process for producing binderless formaldehyde-free fiberboard and coproducing fulvic acid from straw as a raw material, the process comprising:

a: boiling the raw material to achieve purification, activation, and saccharification, followed by defibering and pulp washing to separate and obtain purified and activated cellulose, namely fiber pulp, and primary fulvic acid black liquor;

wherein the primary fulvic acid black liquor is composed of primarily activated lignin and low-molecular-weight monosaccharides generated by a degradation of hemicellulose and non-wood fibers;

b: subjecting the primarily activated lignin to deep activation;

wherein the deep activation comprises concentrating, sulfonating, and phenolizing the primary fulvic acid black liquor to obtain fulvic acid black liquor;

wherein the phenolizing comprises adding at least one of tannic acid, gallic acid, catechin, tea polyphenol, and ferulic acid;

wherein the fulvic acid black liquor is composed of deeply activated lignin and monosaccharide; and c: mixing the fulvic acid black liquor and the fiber pulp to produce the binderless, formaldehyde-free fiberboard, wherein the fulvic acid black liquor serves as both a hardener and a binder.

2. The process for producing binderless formaldehyde-free fiberboard and coproducing fulvic acid from straw according to claim 1, wherein:

the primary fulvic acid black liquor is subjected to extraction through the defibering and pulp washing, thereby obtaining the purified and activated cellulose and the primary fulvic acid black liquor composed of the primarily activated lignin and the monosaccharides; the defibering and pulp washing comprises: separating the cellulose from sulfonated lignin and part of native lignin by mechanical refining and defibering; and carrying out extraction on the primary fulvic acid black liquor by pulp washing to respectively obtain the purified and activated cellulose and the primarily fulvic acid black liquor;

the purified and activated cellulose comprises part of native lignin and part of undegraded hemicellulose;

the primary fulvic acid black liquor comprises sulfonated lignin, native lignin, low-molecular-weight monosaccharides generated by the degradation of the hemicellulose, and low-molecular-weight monosaccharides generated by the degradation of the non-wood fibers, and a solid content of the primary fulvic acid black liquor is 8-10% (w/w); and the sulfonated lignin is the primarily activated lignin.

3. The process for producing binderless formaldehyde-free fiberboard and coproducing fulvic acid from straw according to claim 1, wherein the concentrating comprises: carrying out multiple-effect evaporation to obtain a fulvic acid thick black liquor having a solid content of 40-60% (w/w), wherein distilled water obtained after the concentrating is reused for the boiling and the pulp washing.

4. The process for producing binderless formaldehyde-free fiberboard and coproducing fulvic acid from straw according to claim 3, wherein the sulfonating comprises utilizing waste heat from the concentrating to achieve deep sulfonation and obtain a deeply sulfonated fulvic acid thick black liquor with the following conditions: adding ammonium bisulfite in an amount of 3-6% by weight of the fulvic acid thick black liquor, introducing a catalyst in a range of 0.005-0.01% by weight of the fulvic acid thick black liquor, with the catalyst being at least one of $FeSO_4$, $FeCl_3$, or $CuSO_4$, maintaining at 80-95° C., holding for 90-180 min, and stirring once every minute.

5. The process for producing binderless formaldehyde-free fiberboard and coproducing fulvic acid from straw according to claim 4, wherein the phenolizing comprises phenolizing the deeply sulfonated fulvic acid thick black liquor with the following conditions: adding a phenolizing agent in an amount of 0.01% by weight of the deeply sulfonated fulvic acid thick black liquor, maintaining at 70-80° C., and holding for 60-150 min.

6. The process for producing binderless formaldehyde-free fiberboard and coproducing fulvic acid from straw according to claim 1, wherein an amount of the fulvic acid black liquor added is 10-30% by weight of the purified and activated cellulose, based on dry fulvic acid.

7. The process for producing binderless formaldehyde-free fiberboard and coproducing fulvic acid from straw according to claim 1, wherein part of the fulvic acid black liquor is used as the binder to produce the binderless formaldehyde-free fiberboard, and the rest is sold directly as a commodity, or sold after being dried.

8. The process for producing binderless formaldehyde-free fiberboard and coproducing fulvic acid from straw according to claim 1, wherein the fulvic acid black liquor is mixed with the purified and activated cellulose in the form of liquid, or the fulvic acid black liquor is dried and then mixed with the purified and activated cellulose in the form of powder.

9. The process for producing binderless formaldehyde-free fiberboard and coproducing fulvic acid from straw according to claim 1, wherein the fulvic acid black liquor is used as the hardener and binder, a waterproofing agent is added, and post-treatment, comprising paving, pressing, drying, polishing and trimming, is carried out on the fiberboard.

10. The process for producing binderless formaldehyde-free fiberboard and coproducing fulvic acid from straw according to claim 1, wherein a beating degree of the purified and activated cellulose after the defibering is 20-30° SR, and a weight content of fulvic acid in the primary fulvic acid black liquor, calculated on a dry basis of fulvic acid, is greater than 40%.

11. The process for producing binderless formaldehyde-free fiberboard and coproducing fulvic acid from straw according to claim 1, wherein the straw comprises cotton straw.

12. The process for producing binderless formaldehyde-free fiberboard and coproducing fulvic acid from straw according to claim 1, wherein controlling a pH condition of the boiling to be less than 7 ensures that a color of the purified and activated cellulose is dark red.

13. The process for producing binderless formaldehyde-free fiberboard and coproducing fulvic acid from straw according to claim 1, wherein the boiling uses an ammonium sulfite method for purification, activation, and saccharification which enables a degradation of non-fibrous components in the raw material, as well as part of the hemicellulose in the raw material, into low-molecular-weight monosaccharides through boiling; and the primary activated of lignin is obtained through sulfonation and hydrolysis of lignin in the raw material, facilitating a preliminary separation of cellulose in the raw material and the primarily activated lignin.

14. The process for producing binderless formaldehyde-free fiberboard and coproducing fulvic acid from straw according to claim 13, wherein the boiling is carried out at 140-160° C. for 40-60 min, an amount of the ammonium sulfite is 8-15% by weight of the raw material, and a pH condition of the boiling is 5-7.

* * * * *